US005824122A

United States Patent [19]

Baumgärtel et al.

[11] Patent Number: 5,824,122

[45] Date of Patent: Oct. 20, 1998

[54] PROCESS AND APPARATUS FOR PURIFYING FLAMMABLE GAS

[75] Inventors: Gerd Baumgärtel, Röttenbach; Herbert Tratz, Ottensoos, both of Germany

[73] Assignee: Siemans Aktiengesellschaft, Munich, Germany

[21] Appl. No.: 863,359

[22] Filed: May 27, 1997

Related U.S. Application Data

[63] Continuation of Ser. No. 425,955, Apr. 19, 1995, abandoned.

[30] Foreign Application Priority Data

Oct. 23, 1992 [DE] Germany ..... 42 35 894.9

[51] Int. Cl.[6] ..... C10K 3/06; C10K 1/011; C10K 1/08

[52] U.S. Cl. ..... 48/128; 48/197 R; 110/229; 110/242; 202/182

[58] Field of Search ..... 48/128, 197 R, 48/209, 211; 110/229, 230, 242, 245, 346; 196/99, 108; 202/202, 182; 203/98; 95/193, 195, 197, 209; 55/228, 229

[56] References Cited

U.S. PATENT DOCUMENTS

| | | | |
|---|---|---|---|
| 3,667,193 | 6/1972 | McKenzie | 55/228 |
| 4,007,025 | 2/1977 | Hegemann | 55/258 |
| 4,123,502 | 10/1978 | Hölter et al. | 95/193 |
| 4,206,186 | 6/1980 | Holter et al. | 48/197 R |
| 4,563,195 | 1/1986 | Frauen et al. | 48/197 R |
| 4,643,742 | 2/1987 | Hammarshog | 95/195 |
| 4,769,048 | 9/1988 | Becker et al. | 95/257 |
| 4,854,946 | 8/1989 | Heijwegen et al. | 95/197 |
| 4,878,440 | 11/1989 | Tratz et al. | 110/233 |
| 5,157,202 | 10/1992 | Bauer et al. | 95/190 |

FOREIGN PATENT DOCUMENTS

| | | |
|---|---|---|
| 0 167 702 | 10/1987 | European Pat. Off. . |
| 0 302 310 | 8/1990 | European Pat. Off. . |
| 2 235 731 | 1/1975 | France . |
| 1 017 737 | 10/1957 | Germany . |
| 27 01 800 | 7/1978 | Germany . |
| 31 22 565 | 12/1982 | Germany . |
| 156 711 | 7/1983 | Germany . |
| 37 14 749 | 5/1989 | Germany . |
| 40 40 334 | 6/1992 | Germany . |
| 668 196 | 12/1988 | Switzerland . |
| 983 391 | 2/1965 | United Kingdom . |

*Primary Examiner*—Hien Tran
*Attorney, Agent, or Firm*—Herbert L. Lerner; Laurence A. Greenberg

[57] ABSTRACT

In a process and an apparatus for purifying flammable gas, in particular low-temperature carbonization gas, the gas is scrubbed and discharged as pure gas and condensate. The condensate is distilled in a distillation unit. Volatile constituents are admixed to the pure gas, so that the calorific value of the latter is increased. The non-volatile constituents are discharged. The non-volatile constituents can be fed to a low-temperature carbonization drum and carbonized therein at low temperature.

7 Claims, 1 Drawing Sheet

PROCESS AND APPARATUS FOR PURIFYING FLAMMABLE GAS

CROSS-REFERENCE TO RELATED APPLICATION

This application is a continuation of application Ser. No. 08/425,955, filed Apr. 19, 1995, now abandoned, which is a continuation of international application Serial No. PCT/DE93/00959, filed Oct. 11, 1993.

BACKGROUND OF THE INVENTION

1. Field of the Invention

The invention relates to a process for purifying flammable gas, in particular low-temperature carbonization gas, wherein the gas is scrubbed and discharged as pure gas, and condensate is discharged. The invention also relates to an apparatus for purifying flammable gas, in particular low-temperature carbonization gas, including a gas scrubber which has an inlet line for the gas, an inlet line for a scrubbing medium and a discharge line for condensate and is connected to a discharge line for scrubbed gas (pure gas).

A process and an apparatus for purifying pyrolysis gas are known from German Published, Non-Prosecuted Application DE-OS 27 01 800, corresponding to U.S. Pat. No. 4,206,186. In that case, the objective is to obtain a gas which is as pure as possible. The gas should contain neither oil, nor tar, nor water. For that purpose, the pyrolysis gas is scrubbed in a gas scrubber, wherein the scrubbing medium being used is a scrubbing oil which condenses out in the gas scrubber and is used again. In order to start the unit, a certain quantity of scrubbing oil must be made available. The condensate which is not required as scrubbing oil is burned in a pyrolysis reactor. The gas leaving the gas scrubber is free of oil and tar. It is then treated further in a packed-bed reactor. The purified gas is fed as fuel gas through a blower to the fuel gas burner of the pyrolysis reactor. In the latter, the heating performance is impaired by a dust deposit, since the purified gas still contains dust.

In the prior art, a very pure gas which, however, still contains dust is fed to the fuel gas burner. The known process and apparatus are planned to achieve a good purification performance. However, such a pure fuel gas has a relatively low calorific value, which is further reduced by the dust content. Furthermore, during the purification, substances arise which must be treated further in expensive units that are necessary especially for that purpose. For example, a screen and a combustion chamber are required for further processing of a filter residue from a packed-bed reactor. Residues requiring disposal then arise again in the screen.

SUMMARY OF THE INVENTION

It is accordingly an object of the invention to provide a process and an apparatus for purifying flammable gas, which overcome the hereinafore-mentioned disadvantages of the heretofore-known methods and devices of this general type and which make a gas available that is largely dust-free and nevertheless has the highest possible calorific value.

With the foregoing and other objects in view there is provided, in accordance with the invention, a process for purifying flammable gas, in particular low-temperature carbonization gas, which comprises scrubbing flammable gas and discharging pure gas and condensate; distilling the condensate into volatile constituents and non-volatile constituents; and admixing the volatile constituents to the pure gas and discharging the non-volatile constituents.

As a result of the distillation of condensate, the major part of the flammable constituents of the condensate, namely the volatile constituents, are converted into the gaseous form. These volatile constituents have a very high calorific value. As a result of the volatile constituents from the distillation being admixed to the pure gas, a gas mixture is obtained which advantageously has a very high calorific value. Dust that was originally present in the gas passes into the condensate in the scrubbing process. Upon distillation, the dust remains with the non-volatile constituents. The latter are discharged and can be burned. The dust thus cannot impair the calorific value of the gas mixture.

The water contained in the condensate does not have to be discharged, which would entail effluent problems. At the latest during the distillation, the water is converted to steam which is admixed to the pure gas. This steam fraction only insignificantly affects the calorific value of the pure gas. The quantity of water in the steam fraction is in fact relatively small as compared with the quantity of water of the moisture content that is present anyway in the gas.

The process according to the invention achieves the advantage that no substances requiring disposal, such as filter dusts or effluent, arise in the purification of a flammable gas. It is to be regarded as a particular advantage that a purified pure gas is obtained from which dust has been removed and which has a very high calorific value. Advantageously, the pure gas is freed of dust, while other substances which can raise the calorific value remain constituents of the pure gas. Due to the removal of dust, blockages in fuel gas lines also cannot occur.

In addition to the pure gas, only the non-volatile constituents from the distillation remain, which can be carbonized at low temperature or burned, for which the pure gas can provide heat energy, as fuel gas. External fuel gas is then required only for starting.

The flammable gas to be purified can be a part of a low-temperature carbonization gas formed in a low-temperature carbonization step.

In accordance with a further mode of the invention, the condensate is separated into a heavy fraction and a light fraction. The gas is then scrubbed with the light fraction, and the heavy fraction as well as the excess part of the light fraction are distilled. If only the light fraction of the condensate is used as scrubbing medium, no heavy constituents of the condensate which, for example, contain dust, must be circulated, which would result in the parts of the plant being additionally burdened with dust.

With the objects of the invention in view, there is also provided an apparatus for purifying flammable gas, in particular low-temperature carbonization gas, comprising a gas scrubber having an inlet line for flammable gas, an inlet line for scrubbing medium and a discharge line for condensate; a discharge line for scrubbed gas (pure gas) being connected to the gas scrubber; a distillation unit being connected to the discharge line for condensate; a line for volatile constituents leading from the distillation unit to the discharge line for scrubbed gas (pure gas); and a line for non-volatile constituents leading from the distillation unit.

The advantage thereof is that the condensate constituents which are volatile in the distillation serve for increasing the calorific value of the pure gas to which they are admixed. The pure gas is advantageously dust-free. Remaining residual substances are discharged only through the line for non-volatile constituents. However, these residual substances, which also include the dust separated from the gas, can be carbonized at low temperature or burned.

In accordance with another feature of the invention, the line for non-volatile constituents is connected to a low-temperature carbonization unit and/or to a burner unit. This low-temperature carbonization unit can provide a low-temperature carbonization gas which can be the flammable gas which is to be purified in the apparatus according to the invention.

In accordance with a further feature of the invention, the discharge line for scrubbed gas (pure gas) is connected to a fuel gas burner.

In accordance with an added feature of the invention, the fuel gas burner is a part of the low-temperature carbonization unit or burner unit.

The apparatus according to the invention can thus be a part of a largely closed system. In this case, a partial stream of the low-temperature carbonization gas, coming from a low-temperature carbonization unit, can be purified, in which case exclusively only dust-free pure gas and non-volatile substances arising in a distillation remain. These substances can be carbonized at low temperature in the low-temperature carbonization unit. The pure gas can be burned in a fuel gas burner and can serve for heating the low-temperature carbonization unit. Apart from the low-temperature carbonization residue and excess low-temperature carbonization gas, no wastes requiring disposal arise.

In accordance with an additional feature of the invention, the low-temperature carbonization unit is a low-temperature carbonization drum of a low-temperature carbonization-combustion plant that is known for this purpose, for example from European Patent No. 0 302 310 B1, corresponding to U.S. Pat. No. 4,878,440.

For example, the discharge line for condensate from the gas scrubber is connected to a settling vessel. The condensate collects in this settling vessel. The heavier constituents settle in the latter. The lighter constituents form a layer above the heavier constituents. The heavier constituents contain predominantly the dust, and the lighter constituents are water and/or oil.

In accordance with yet another feature of the invention, the inlet line of the gas scrubber for scrubbing medium branches off in the middle region of the settling vessel. This ensures that lighter constituents of the condensate, which do not contain any dust, pass as scrubbing medium into the gas scrubber. A discharge line for excess condensate starts from the bottom of the settling vessel. The heavier constituents of the condensate, which contain dust, are discharged through this discharge line. The discharge line for scrubbed gas starts from the top of the settling vessel.

The use of a settling vessel advantageously ensures that lighter constituents of the condensate, which are largely free of dust, can be fed as scrubbing medium to the gas scrubber.

In accordance with yet a further feature of the invention, the discharge line for excess condensate, starting from the settling vessel, is connected to a hydrocyclone from which a discharge line for a lighter fraction and a discharge line for a heavier fraction start. The discharge line for a lighter fraction leads into the upper part of the settling vessel. The discharge line for a heavier fraction leads into the lower part of the settling vessel. The condensate being introduced is separated once more in the hydrocyclone. This gives an even better division into a lighter, purer fraction and a heavier, dust-laden fraction. The lighter fraction passes from above into the settling vessel, whereas the heavier fraction passes into the lower part of the settling vessel. In this way, the fractions being separated in the hydrocyclone are advantageously added to the corresponding condensate quantities in the settling vessel. Remixing in the settling vessel is thereby largely precluded. The use of the hydrocyclone advantageously achieves an even further improved separation of the condensate into a heavier fraction and a lighter fraction.

In accordance with a concomitant feature of the invention, the settling vessel has a main chamber and a subsidiary chamber. The discharge line of the hydrocyclone for the heavier fraction leads into the lower part of the subsidiary chamber. The latter has an overflow leading into the main chamber and is connected at the bottom to a discharge line for excess condensate. This has the advantage of providing three successive separation stages for the condensate. After a heavier fraction of the condensate has settled in the main chamber of the settling vessel, this heavier fraction passes into the hydrocyclone. The heavier fraction being separated off therein passes into the subsidiary chamber of the settling vessel, where a further settling step takes place. From there, the lighter fraction of the condensate flows through the overflow into the main chamber, and the heavier fraction is released, for example into the distillation unit. The division of the condensate is even further improved by the use of a settling vessel which has a main chamber and a subsidiary chamber.

The process and the apparatus according to the invention have the advantage of providing a purified gas which has a very high calorific value, because it is freed of dust which can reduce the calorific value, and because substances effecting a high calorific value are recovered by distillation and admixed to the pure gas. Moreover, the process and the apparatus provide the advantage of ensuring that no wastes arise which would require further treatment. No effluent arises, nor a substance which would not be suitable for passing to a burner unit, for example a low-temperature carbonization drum. At temperatures above 100° C. in the distillation unit, even water which may be present passes into the pure gas stream in the form of steam. The calorific value of the pure gas is not impaired by the small quantities of steam, because the gas is moist anyway. However, the advantage is obtained that no effluent arises. In particular, no extraneous medium is required for purifying the flammable gas, except for starting up the unit.

Other features which are considered as characteristic for the invention are set forth in the appended claims.

Although the invention is illustrated and described herein as embodied in a process and an apparatus for purifying flammable gas, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a schematic circuit diagram of an apparatus for performing the method of purifying flammable gas according to the invention.

DESCRIPTION OF THE PREFERRED EMBODIMENTS

Figure 1:
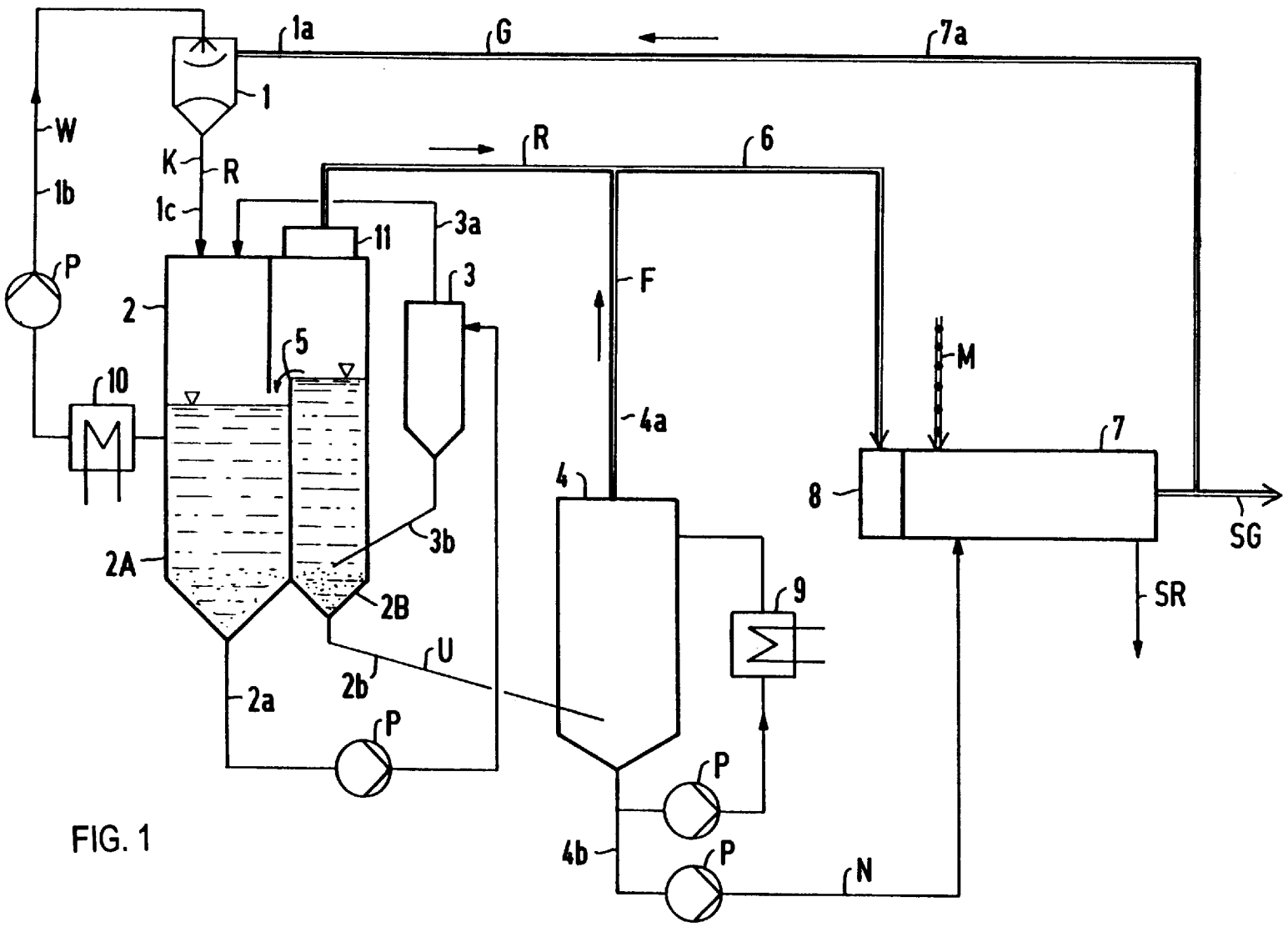

Referring now to the single FIGURE of the drawing in detail, it is seen that a flammable gas G which is to be purified and can, for example, be an entire low-temperature carbonization gas SG or a part thereof, is delivered from a low-temperature carbonization drum 7 that is known per se. The gas is supplied through a low-temperature carbonization gas line 7*a* which starts from the low-temperature carbonization drum 7. The flammable gas G passes through an inlet line 1*a,* which can be connected to the low-temperature carbonization gas line 7*a,* into a gas scrubber 1 which can be a venturi scrubber. The gas scrubber 1 also has an inlet line 1*b* for a scrubbing medium W and a discharge line 1*c* for condensate K and pure gas R. The latter line is connected through a precipitation device 11 for condensate aerosols to a discharge line 6 for scrubbed gas (pure gas) R.

The discharge line 1*c* of the gas scrubber 1 is connected to a settling vessel 2 in which heavier constituents of the condensate K settle out. These heavier constituents contain a lot of dust, whereas the lighter constituents in the layer above only contain a little dust and can be formed of oil and water. If the temperature in the settling vessel 2 is above 100° C., the lighter fraction of the condensate K is formed only of oil. The inlet line 1*b* of the gas scrubber 1 for the scrubbing medium W starts from approximately the middle of the settling vessel 2. As a result, a part of the lighter, low-dust constituents of the condensate K passes as scrubbing medium W into the gas scrubber 1. The inlet line 1*b* can be associated with a cooling unit 10. A discharge line 2*a* for the heavier fraction of the condensate K starts from the bottom of the settling vessel 2. The excess of lighter condensate K is also released through the discharge line 2*a*. The discharge line 6 for scrubbed gas (pure gas) R starts from the top of the settling vessel 2. The discharge line 2*a* for condensate K can be connected to a hydrocyclone 3, in which the condensate K is separated further. A lighter fraction passes through a discharge line 3*a* from above into the settling vessel 2. A heavier fraction passes through a discharge line 3*b* into the lower part of the settling vessel 2. The two fractions are thereby recycled into the settling vessel 2 at suitable points.

For example, the settling vessel 2 can have a main chamber 2A and a subsidiary chamber 2B. The heavier fraction from the hydrocyclone 3 is then fed through the discharge line 3*b* into the lower part of the subsidiary chamber 2B. In the subsidiary chamber 2B, a third separation step takes place in the condensate K. The lighter fraction flows at an overflow 5 from the subsidiary chamber 2B into the main chamber 2A. An excess condensate U remaining after the three separation steps passes through a discharge line 2*b* into a distillation unit 4. The discharge line 6 for the pure gas R can start from the upper part of the subsidiary chamber 2B of the settling vessel 2. The precipitation device 11 for condensate aerosols can be disposed downstream of the subsidiary chamber 2B and upstream of the discharge line 6.

In the distillation unit 4, which is heated by a heater 9, volatile constituents F of the excess condensate U are separated from non-volatile constituents N thereof. A line 4*a* for the volatile constituents F starts from the upper part of the distillation unit 4 and leads into the discharge line 6 for scrubbed gas (pure gas) R. A line 4*b* for the non-volatile constituents N starts from the lower part of the distillation unit 4. The non-volatile constituents N contain all of the dust removed from the flammable gas G to be purified. Furthermore, the non-volatile constituents N also contain tarry substances. The non-volatile constituents N are combustible and can, for example, be carbonized at low temperature in the low-temperature carbonization drum 7 of a low-temperature carbonization-combustion plant which is known for this purpose. In this case, the line 4*b* can be connected to the low-temperature carbonization drum 7. The pure gas R enriched with the volatile constituents F can be used as fuel gas for the low-temperature carbonization drum 7. For this purpose, the discharge line 6 for pure gas R is connected to a fuel gas burner 8 which is a component of the low-temperature carbonization drum 7. The pure gas R is burned in the fuel gas burner 8. The heat energy thus made available serves for heating the low-temperature carbonization drum 7.

The heating of the distillation unit 4 is effected by heating a circulated liquid phase in the heat exchanger 9. In order to transfer the medium, there can be pumps P in all of the lines.

The illustrated apparatus releases neither effluent nor waste gas. The non-volatile constituents N of the excess condensate U can be carbonized at low temperature without any problems in the low-temperature carbonization drum 7. The volatile constituents F of the excess condensate U increase the calorific value of the dust-free pure gas R, so that the latter can be used as fuel gas for the low-temperature carbonization drum 7. Except during start-up of the unit, no extraneous medium is required for removing the dust from the gas G which is to be purified. The scrubbing medium W for the gas G is obtained from the condensate K. In conjunction with a low-temperature carbonization drum 7, no additional wastes arise. With the usual feeding of domestic refuse M or other wastes into the low-temperature carbonization drum 7, low-temperature carbonization residue SR and excess low-temperature carbonization gas SG are discharged from the latter, and these can be further processed in a known manner in a low-temperature carbonization-combustion plant that is known per se.

We claim:

1. An apparatus for purifying flammable gas, comprising:

inlet line for scrubbing medium and a discharge line for condensate;

a discharge line for scrubbed gas in fluid communication with said gas scrubber;

a distillation unit in communication with said discharge line for condensate;

a line for volatile constituents leading from said distillation unit to said discharge line for scrubbed gas;

a fuel gas burner connected to said discharge line for scrubbed gas to mix said scrubbed gas with said volatile constituents; and a line for non-volatile constituents leading from said distillation unit.

2. The apparatus according to claim 1, including a low-temperature carbonization unit being connected to said line for non-volatile constituents.

3. The apparatus according to claim 2, wherein the fuel gas burner is associated with said low-temperature carbonization unit.

4. The apparatus according to claim 2, wherein said low-temperature carbonization unit is a low-temperature carbonization drum of a low-temperature carbonization-combustion plant.

5. The apparatus according to claim 1, including a settling vessel being connected to said discharge line for condensate, said settling vessel having a top, a middle level and a bottom, said inlet line of said gas scrubber for scrubbing medium leading from said middle level, said discharge line for scrubbed gas leading from said top, and a discharge line for excess condensate leading from said bottom, and in communication with said distillation unit.

6. The apparatus according to claim 5, including a hydrocyclone connected to said discharge line for excess condensate, a first discharge line leading from said hydrocyclone into said top of said settling vessel, and a second discharge line leading from said hydrocyclone into said bottom of said settling vessel.

7. The apparatus according to claim 6, wherein said settling vessel has a main chamber and a subsidiary chamber, said subsidiary chamber extending in a direction from said bottom to said top of said settling vessel, said subsidiary chamber has a lower part and a bottom, said second discharge line leads from said hydrocyclone into said lower part of said subsidiary chamber, said subsidiary chamber has an overflow leading into said main chamber, and including a discharge line for excess condensate being connected from said bottom of said subsidiary chamber to said distillation unit.

* * * * *